United States Patent [19]

Walter

[11] 4,296,353

[45] Oct. 20, 1981

[54] FLUORESCENT LAMP HAVING HIGH COLOR RENDERING INDEX

[75] Inventor: Wolfgang Walter, Brookline, Mass.

[73] Assignee: GTE Products Corporation, Stamford, Conn.

[21] Appl. No.: 89,642

[22] Filed: Oct. 29, 1979

[51] Int. Cl.[3] ..... H01J 1/62

[52] U.S. Cl. ..... 313/487

[58] Field of Search ..... 313/487, 486

[56] References Cited

U.S. PATENT DOCUMENTS

| | | | |
|---|---|---|---|
| 3,778,660 | 12/1973 | Kamiya et al. | 313/486 |
| 4,055,781 | 10/1977 | Schreurs | 313/487 |
| 4,199,707 | 4/1980 | Akiyama et al. | 313/487 |

FOREIGN PATENT DOCUMENTS

| | | | |
|---|---|---|---|
| 953904 | 9/1974 | Canada | 313/487 |
| 888337 | 1/1962 | United Kingdom | 313/487 |

*Primary Examiner*—Stanley T. Krawczewicz

*Attorney, Agent, or Firm*—James Theodosopoulos

[57] ABSTRACT

A fluorescent lamp having a high color rendering index and high efficacy comprises a glass envelope having electrodes at its ends and contains a fill including mercury and a starting gas, and a phosphor coating on the inner surface of the glass envelope, the phosphor coating comprising a blend of four narrow band emitting phosphors.

9 Claims, 1 Drawing Figure

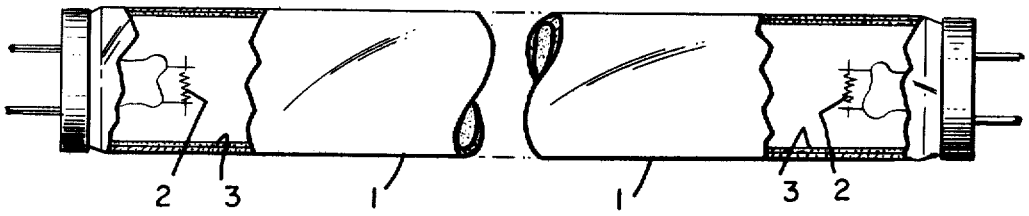
2
3
1
1
3
2

FLUORESCENT LAMP HAVING HIGH COLOR RENDERING INDEX

DESCRIPTION

1. Technical Field

This invention is concerned with fluorescent lamps. Such lamps are low pressure arc discharge lamps and comprise a sealed glass tube having electrodes at its ends and containing a fill including mercury. There is a phosphor coating on the inner surface of the tube which converts UV radiation from the mercury arc discharge into visible radiation.

2. Background Art

This invention is particularly concerned with fluorescent lamps containing phosphor blends. Such blends are often used to improve lamp efficacy or color rendering index (CRI) or lamp maintenance. Two component phosphor blends are discussed in my paper entitled "Optimum Phosphor Blends For Fluorescent Lamps", Applied Optics, Vol. 10, p. 1108 (1971). Three component blends are disclosed in U.S. Pat. Nos. 3,858,082 and 3,937,998.

DISCLOSURE OF INVENTION

In this invention, a four component blend of phosphors is used in a fluorescent lamp. The phosphors emit in narrow bands and can produce a high CRI lamp with good efficacy, say, about 90–110 lumens per watt. The CRI can be as high as 90 to 95; it is surprising that such a high CRI can be obtained from a blend of four narrow band phosphors. The emission bands of the four phosphors should be centered at about 450–480 nm, 510–540 nm, 570–590 nm and 600–630 nm.

BRIEF DESCRIPTION OF THE DRAWING

The single FIGURE in the drawing shows a fluorescent lamp in accordance with this invention.

BEST MODE FOR CARRYING OUT THE INVENTION

A fluorescent lamp in accordance with this invention comprises a glass envelope 1 containing a starting gas and a small quantity of mercury. There are electrodes 2 at each end of the lamp between which an electrical discharge takes place during lamp operation. The inner surface of envelope 1 is coated with a layer 3 comprising a blend of four narrow band phosphors as per this invention.

The phosphors can be blended together in different ratios to obtain the different standard white colors for fluorescent lamps. The spectral power distribution curves for the phosphor blends consist of four narrow bands centered at about 450–480 nm, 510–540 nm, 570–590 nm and 600–630 nm. For the Cool White lamp, the ratio of the power emitted in the four respective bands is approximately 1:1.59:1.2:1.64. The ratio for the White lamp is about 1:2.09:1.86:2.76. For the Warm White, the ratio is about 1:2.64:2.75:4.49 and, for Daylight, about 1:1.1:0.63:0.76. At these ratios, the fluorescent lamps have optimal emitted spectral power distributions with combinations of efficacy and CRI not previously achieved. A method of describing the overall performance of a fluorescent lamp is in terms of the product of CRI and luminous efficacy. Expressed in such terms, the lamps as per this invention have a performance of 8000–10,000. In contrast, the lamps disclosed in U.S. Pat. No. 3,858,082 only have a performance of 6300–7000.

Examples of the phosphors that can be used in the practice of this invention are as follows. The 450–480 nm phosphor can be divalent europium activated barium magnesium aluminate, $BaMg_2Al_{16}O_{27}:Eu^{2+}$ which has a peak emission at 450 nm with a band width of 50 nm at half maximum height. The 510–540 nm phosphor can be manganese activated zinc orthosilicate, $Zn_{1.995}Mn_{0.005}SiO_4$, which has a peak emission at 525 nm with a half height band width of 36 nm. The 570–590 nm phosphor can be trivalent dysprosium activated yttrium vanadate $YVO_4:Dy^{3+}$, which has a peak emission at 576 nm with a half height band width of about 6 nm. The 600–630 nm phosphor can be trivalent europium activated yttrium oxysulfide, $Y_2O_2S:Eu^{3+}$, which has a peak emission at 625 nm with a half height band width of 3 nm.

A phosphor blend for a Cool White lamp could consist of 100 grams of the divalent europium activated barium magnesium aluminate phosphor, 159 grams of the manganese activated orthosilicate phosphor, 120 grams of the trivalent dysprosium activated yttrium vanadate phosphor and 164 grams of the trivalent europium activated yttrium oxysulfide phosphor. For the White lamp, the phosphor blend could consist of 100 grams, 209 grams, 186 grams and 276 grams of the same respective phosphors. The blend for the Warm White lamp could consist of 100 grams, 264 grams and 449 grams of the same respective phosphors. For the Daylight lamp, the blend could consist of 100 grams, 110 grams, 63 grams and 76 grams of the same respective phosphors. However, all these amounts would have to be increased inversely to the quantum efficiency of the phosphor. For example, the quantum efficiency of the manganese activated zinc orthosilicate is 0.7; therefore the amounts of the manganese activated zinc orthosilicate above would have to be multiplied by the reciprocal of 0.7.

I claim:

1. A fluorescent lamp having a high color rendering index and high efficacy comprising a glass envelope having electrodes at its ends and containing a fill including mercury and a starting gas, and a phosphor coating on the inner surface of the glass envelope, the phosphor coating comprising a blend of four narrow band emitting phosphors, the respective peak emissions of said four phosphors being in the regions of about 450–480 nm, 510–540 nm, 570–590 nm and 600–630 nm.

2. The lamp of claim 1 wherein the lamp is a Cool White lamp and the ratio of said four phosphors in said blend is about, respectively, 1:1.59:1.2:1.64.

3. The lamp of claim 1 wherein the lamp is a White lamp and the ratio of said four phosphors in said blend is about, respectively, 1:2.09:1.86:2.76.

4. The lamp of claim 1 wherein the lamp is a Warm White lamp and the ratio of said four phosphors in said blend is about, respectively, 1:2.64:2.75:4.49.

5. The lamp of claim 1 wherein the lamp is a Daylight lamp and the ratio of said four phosphors in said blend is about, respectively, 1:1.1:0.63:0.76.

6. The lamp of claim 1 wherein the 450–480 nm phosphor is divalent europium activated barium magnesium aluminate.

7. The lamp of claim 1 wherein the 510–540 nm phosphor is manganese activated zinc orthosilicate.

8. The lamp of claim 1 wherein the 570–590 nm phosphor is trivalent dysprosium activated yttrium vanadate.

9. The lamp of claim 1 wherein the 600–630 nm phosphor is trivalent activated yttrium oxysulfide.

* * * * *